US009544974B2

(12) United States Patent
Kang et al.

(10) Patent No.: US 9,544,974 B2
(45) Date of Patent: Jan. 10, 2017

(54) LIGHT EMITTING MODULE AND LIGHTING UNIT INCLUDING THE SAME

(71) Applicant: LG INNOTEK CO., LTD., Seoul (KR)

(72) Inventors: Il Yeong Kang, Seoul (KR); Sang Hoon Lee, Seoul (KR); Keun Tak Joo, Seoul (KR); Tae Young Choi, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 365 days.

(21) Appl. No.: 14/146,023

(22) Filed: Jan. 2, 2014

(65) Prior Publication Data

US 2014/0191677 A1 Jul. 10, 2014

(30) Foreign Application Priority Data

Jan. 4, 2013 (KR) ..... 10-2013-0001058

(51) Int. Cl.
*H05B 37/00* (2006.01)
*H05B 39/00* (2006.01)
(Continued)

(52) U.S. Cl.
CPC ..... *H05B 37/0209* (2013.01); *H05B 33/0827* (2013.01)

(58) Field of Classification Search
USPC ..... 315/193, 64, 186, 313
See application file for complete search history.

(56) References Cited

U.S. PATENT DOCUMENTS

2014/0210361 A1* 7/2014 Ferrier ..... H05B 33/0812 315/186
2014/0252967 A1* 9/2014 van de Ven ..... H05B 33/083 315/188

(Continued)

FOREIGN PATENT DOCUMENTS

EP 1 564 709 A2 8/2005

OTHER PUBLICATIONS

European Search Report dated May 9, 2014 issued in Application No. 13 199 524.3.

*Primary Examiner* — Adam Houston
(74) *Attorney, Agent, or Firm* — KED & Associates, LLP

(57) ABSTRACT

A light emitting module includes a body, first to $M^{th}$ (wherein, M is an integer of 2 or greater) light emitting devices provided on the body to be spaced apart from each other, and a turn-on controller controlling the first to $M^{th}$ light emitting devices to turn on. An $m^{th}$ ($1 \le m \le M$) light emitting device among the first to $M^{th}$ light emitting devices comprises first to $N^{th}$ (wherein, N is an integer of 2 or greater) light emitting cells connected to each other in series. An $n^{th}$ ($1 \le n \le N$) light emitting cell among the first to $N^{th}$ light emitting cells includes at least one light emitting structure, and the turn-on controller simultaneously turns on or turns off the $n^{th}$ light emitting cells of the first to $M^{th}$ light emitting devices.

20 Claims, 10 Drawing Sheets

(51) Int. Cl.

| | |
|---|---|
| ***H05B 41/00*** | (2006.01) |
| ***H05B 37/02*** | (2006.01) |
| ***H05B 33/08*** | (2006.01) |

(56) References Cited

U.S. PATENT DOCUMENTS

2014/0292218 A1* 10/2014 Vos ..... H05B 33/0815 315/193
2014/0312789 A1* 10/2014 Feng ..... H02M 3/33507 315/186
2015/0237697 A1* 8/2015 Shin ..... H05B 33/0824 315/186
2015/0271882 A1* 9/2015 Melanson ..... H05B 33/0815 315/186
2015/0319814 A1* 11/2015 Grotsch ..... H05B 33/0803 315/186
2015/0351169 A1* 12/2015 Pope ..... H05B 33/086 315/193
2015/0373790 A1* 12/2015 Boswinkel ..... H05B 33/083 315/186
2015/0382415 A1* 12/2015 Wang ..... H05B 33/083 315/186
2015/0382420 A1* 12/2015 Sakai ..... H05B 33/0803 315/193
2016/0029444 A1* 1/2016 Kamoi ..... H05B 33/083 315/193
2016/0044754 A1* 2/2016 Xu ..... H05B 33/0845 315/186
2016/0073461 A1* 3/2016 Jao ..... H05B 33/083 315/186
2016/0081143 A1* 3/2016 Wang ..... H05B 33/0815 315/186
2016/0100463 A1* 4/2016 Jao ..... H05B 33/0812 315/193
2016/0100464 A1* 4/2016 Shackle ..... H05B 33/0821 315/122
2016/0113080 A1* 4/2016 Hsing Chen ..... H05B 33/0845 315/186
2016/0121783 A1* 5/2016 Takagimoto ..... B60Q 11/005 315/82
2016/0135256 A1* 5/2016 Kim ..... H05B 33/083 315/186
2016/0135262 A1* 5/2016 Murakami ..... H05B 33/0815 315/186
2016/0143102 A1* 5/2016 McDonald, II .... H05B 33/0842 315/193

* cited by examiner

LIGHT EMITTING MODULE AND LIGHTING UNIT INCLUDING THE SAME

CROSS REFERENCE TO RELATED APPLICATION

This application claims priority under 35 U.S.C. §119 to Korean Patent Application No. 10-2013-0001058, filed in Korea on 4 Jan. 2013, which is hereby incorporated in its entirety by reference as if fully set forth herein.

BACKGROUND

1. Field

Embodiments relate to a light emitting module and a lighting unit including the same.

2. Background

Light emitting devices, such as light emitting diodes or laser diodes, using Group III-V or II-VI compound semiconductor materials may produce various colors such as red, green, blue, and ultraviolet, thanks to development of thin film growth technologies and device materials. In addition, these light emitting devices may produce high-efficiency white light using fluorescent materials or through color mixing and have advantages, such as low power consumption, semi-permanent lifespan, rapid response time, safety, and environmental friendliness, as compared to conventional light sources, such as fluorescent lamps and incandescent lamps.

Therefore, such light emitting devices are increasingly applied to transmission modules of optical communication units, light emitting diode backlight units substituting for cold cathode fluorescence lamps (CCFLs) constituting backlight units of liquid crystal display (LCD) devices, lighting apparatuses using white light emitting diodes substituting for fluorescent lamps or incandescent lamps, headlights for vehicles, and traffic lights.

FIG. 1 is a schematic plan view of a conventional light emitting module 10.

The light emitting module 10 of FIG. 1 includes a plurality of light emitting devices 32, 34, 36, 38, 42, 44, 46 and 48 and a control circuit 20. Each of the light emitting devices 32, 34, 36, 38, 42, 44, 46 and 48 includes a plurality of light emitting structures connected in series. In this regard, the control circuit 20 controls the light emitting devices 32, 34, 36, 38, 42, 44, 46 and 48 to turn on and off according to level of a driving voltage applied from the outside. That is, the light emitting devices 32 and 42 are turned on when the level of the driving voltage is low, the light emitting devices 32, 34, 42 and 44 are turned on as the level of the driving voltage gradually increases, the light emitting devices 32, 34, 36, 42, 44 and 46 are turned on as the level of the driving voltage further increases, and all the light emitting devices 32, 34, 36, 38, 42, 44, 46 and 48 are turned on when the level of the driving voltage reaches a certain level.

Even though light emitting devices are sequentially turned on as described above, uniformity ratio of illumination and power consumption of the light emitting devices 32, 34, 36, 38, 42, 44, 46 and 48 of the conventional light emitting module 10 are not constant due to the disposition thereof as illustrated in FIG. 1.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
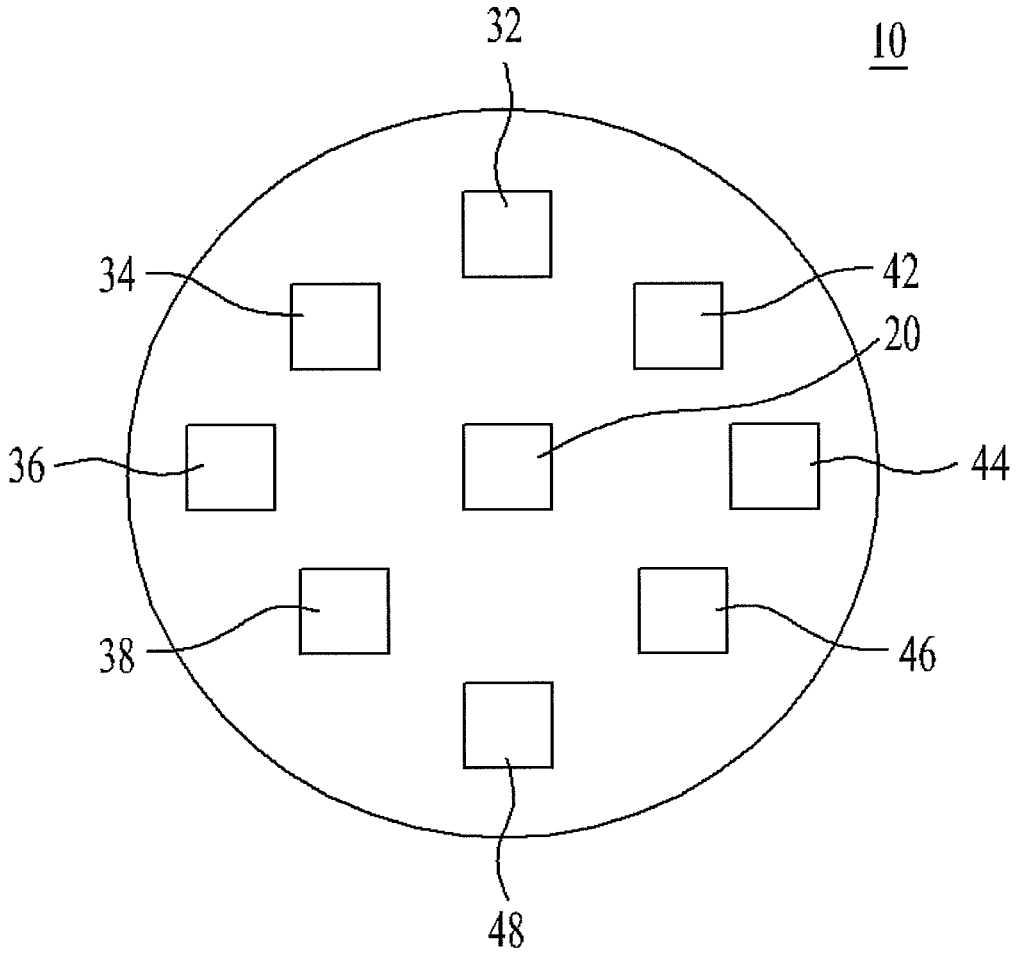
FIG. 1 is a schematic plan view of a conventional light emitting module.

Hereinafter, embodiments will be described in detail with reference to the annexed drawings. However, the disclosure may be embodied in many different forms and should not be construed as being limited to embodiments set forth herein. Rather, these embodiments are provided so that this disclosure will be thorough and complete, and will fully convey the scope of the disclosure to those skilled in the art.

It will be understood that when an element is referred to as being "on" or "under" another element, it can be directly on/under the element or one or more intervening elements may also be present. When an element is referred to as being "on" or "under", "under the element" as well as "on the element" can be included based on the element.

In the drawings, the thickness or size of each layer may be exaggerated, omitted, or schematically illustrated for clarity and convenience of explanation. In addition, the size of each element does not wholly reflect an actual size thereof.

Figure 2:
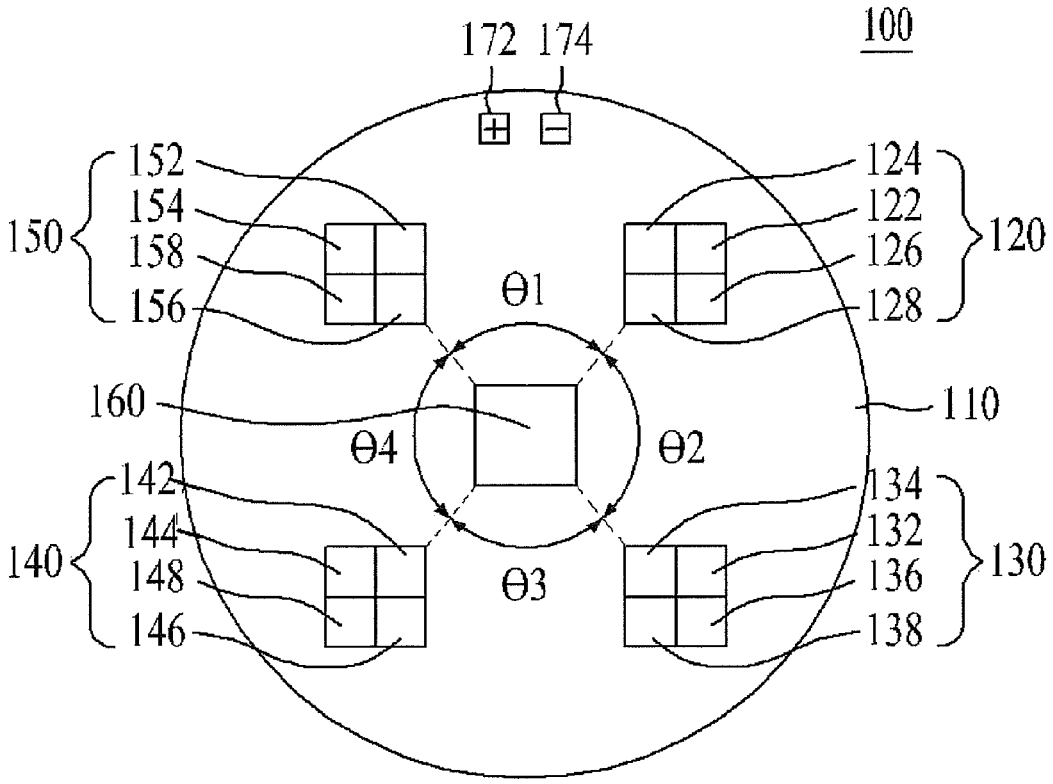
FIG. 2 is a plan view of a light emitting module according to an embodiment.

FIG. 2 is a plan view of a light emitting module 100 according to an embodiment.

Referring to FIG. 2, the light emitting module 100 includes a body 110, first to $M^{th}$ light emitting devices, e.g., first to fourth light emitting devices 120 to 150, a turn-on controller 160, and external power input terminals 172 and 174. Here, M is a natural number of 2 or greater.

Hereinafter, a case in which M=4 as illustrated in FIG. 2 will be described for convenience of explanation, but embodiments are not limited thereto. That is, the following description may be equally applied to a case in which M exceeds 4 or is less than 4.

The body 110 may be formed of silicone, a synthetic resin, or a metal. If the body 110 is formed of a conductive material, such as a metal, a surface of the body 110 may be coated with an insulating layer, although not shown, to prevent electrical short circuit between first and second lead frames.

The first to fourth light emitting devices 120 to 150 are disposed on the body 110 to be spaced apart from each other. Each of the first to fourth light emitting devices 120 to 150 includes first to $N^{th}$ light emitting cells connected to each other in series. Here, N is an integer of 2 or greater.

Hereinafter, a case in which N=4 as illustrated in FIG. 2 will be described by way of example for convenience of explanation, but embodiments are not limited thereto. That is, the following description may be equally applied to a case in which N exceeds 4 or is less than 4.

Referring to FIG. 2, the first light emitting device 120 includes first, second, third and fourth light emitting cells 122, 124, 126 and 128 connected to each other in series, the second light emitting device 130 includes first, second, third and fourth light emitting cells 132, 134, 136 and 138 connected to each other in series, and the third light emitting device 140 includes first, second, third and fourth light emitting cells 142, 144, 146 and 148 connected to each other in series, and the fourth light emitting device 150 includes first, second, third and fourth light emitting cells 152, 154, 156 and 158 connected to each other in series.

Each of the first light emitting cells 122, 132, 142 and 152, the second light emitting cells 124, 134, 144 and 154, the third light emitting cells 126, 136, 146 and 156, and the fourth light emitting cells 128, 138, 148 and 158 that are respectively included in the first to fourth light emitting devices 120 to 150 includes at least one light emitting structure. For example, each of the first light emitting cells 122, 132, 142 and 152, the second light emitting cells 124, 134, 144 and 154, the third light emitting cells 126, 136, 146 and 156, and the fourth light emitting cells 128, 138, 148 and 158 may include a plurality of light emitting structures connected to each other in series. The light emitting structure may for example be embodied as a light emitting diode LED. The LED may include a color LED configured to emit red, green, blue, or white light, and an ultraviolet (UV) LED configured to emit UV light. Shapes of these light emitting devices, light emitting cells and light emitting structures will be described below in detail with reference to FIGS. 5 to 9.

Referring to FIG. 2, the first to fourth light emitting devices 120 to 150 may be disposed on the body 110 to be spaced apart by equal distances θ1, θ2, θ3 and θ4 from each other. A separation distance among the first to fourth light emitting devices 120 to 150 may be between 72° and 120°. As illustrated in FIG. 2, if M=4, the separation distance θ1 between the fourth light emitting device 150 and the first light emitting device 120, the separation distance θ2 between the first light emitting device 120 and the second light emitting device 130, the separation distance θ3 between the second light emitting device 130 and the third light emitting device 140, and the separation distance θ4 between the third light emitting device 140 and the fourth light emitting device 150 may be 90°. In another embodiment, if M=3, separation distances among first to third light emitting devices may be 120° and, if M=5, separation distances among first to fifth light emitting devices may be 72°.

In addition, the first light emitting cells 122, 132, 142 and 152, the second light emitting cells 124, 134, 144 and 154, the third light emitting cells 126, 136, 146 and 156, and the fourth light emitting cells 128, 138, 148 and 158 of the respective first, second, third and fourth light emitting devices 120, 130, 140 and 150 may be disposed equal distances from each other. For example, as illustrated in FIG. 2, the first, second, third and fourth light emitting cells 122, 124, 126 and 128 of the first light emitting device 120 having a tetragonal plane shape may be disposed in a constant form by contacting each other, the first, second, third and fourth light emitting cells 132, 134, 136 and 138 of the second light emitting device 130 may be disposed in a constant form by contacting each other, the first, second, third and fourth light emitting cells 142, 144, 146 and 148 of the third light emitting device 140 may be disposed in a constant form by contacting each other, and the first, second, third and fourth light emitting cells 152, 154, 156 and 158 of the fourth light emitting device 150 may be disposed in a constant form by contacting each other.

The first to fourth light emitting devices 120 to 150 may be disposed on the body 110 different distances, not equal distances, from one another. That is, the separation distances θ1, θ2, θ3 and θ4 may differ from each other.

In addition, as illustrated in FIG. 2, the first to fourth light emitting devices 120 to 150 may be disposed equal distances from one another in a radial direction about the turn-on controller 160, but embodiments are not limited thereto.

The turn-on controller 160 controls the first to fourth light emitting devices 120 to 150 to turn on. In this regard, the turn-on controller 160 may simultaneously turn on or turn off an $n^{th}$ light emitting cell of each of the first to fourth light emitting devices 120 to 150. Here, $1 \leq n \leq N$. The turn-on controller 160 controls the first to fourth light emitting devices 120 to 150 to turn on or turn off according to level of a driving voltage applied from the outside via the external power input terminals 172 and 174.

Referring to FIG. 2, the turn-on controller 160 is disposed at the center of the body 110, but embodiments are not limited thereto. That is, the turn-on controller 160 may be disposed at an edge portion of the body 110, not at the center of the body 110.

Hereinafter, control operations of the turn-on controller 160 will be described with reference to FIGS. 3 and 4.

Figure 3:
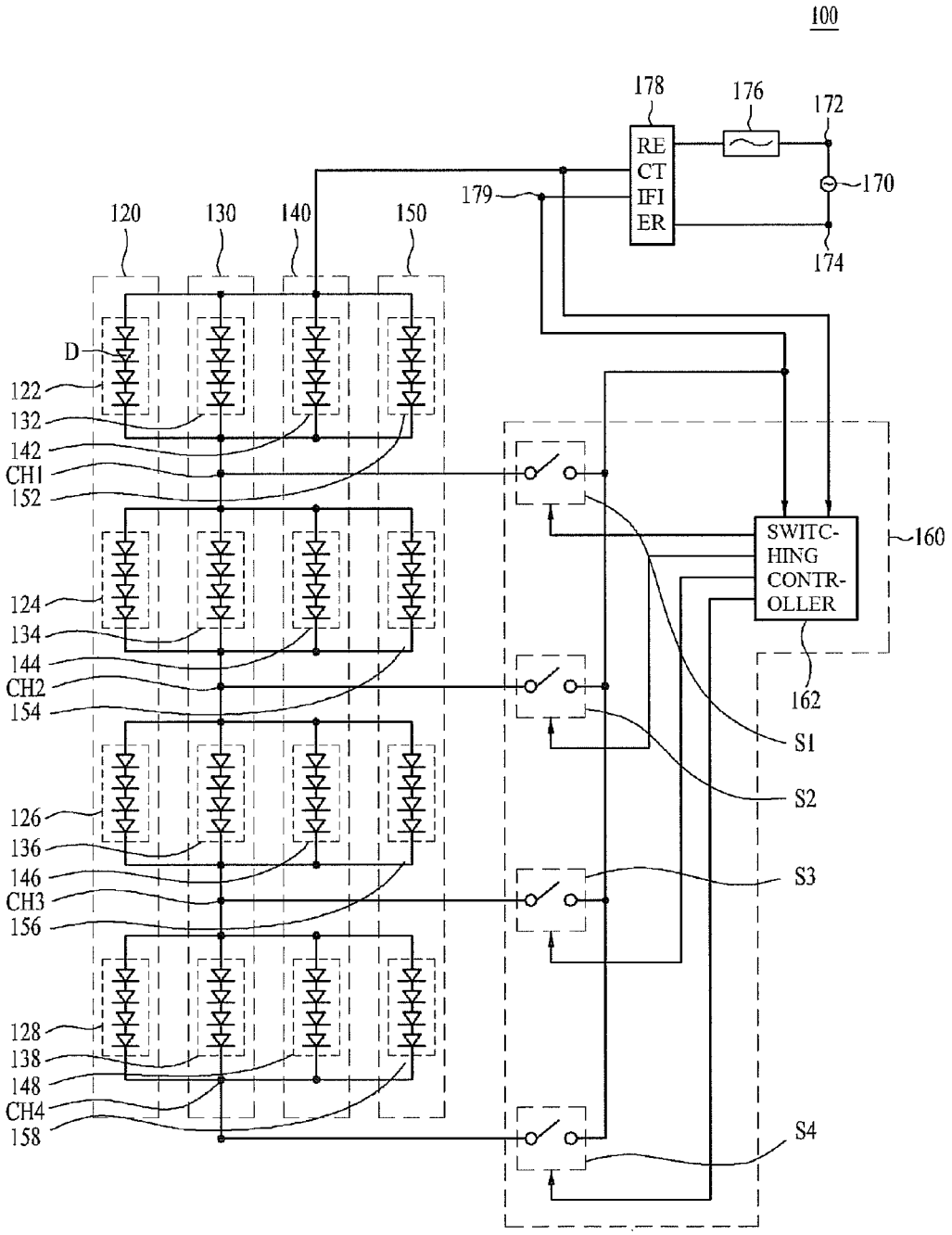
FIG. 3 is a circuit diagram of the light emitting module of FIG. 2.

FIG. 3 is a circuit diagram of the light emitting module 100 of FIG. 2, according to an embodiment. Although FIG. 3 illustrates that each of the first light emitting cells 122, 132, 142 and 152, the second light emitting cells 124, 134, 144 and 154, the third light emitting cells 126, 136, 146 and 156, and the fourth light emitting cells 128, 138, 148 and 158 includes four light emitting structures D connected to one another in series, embodiments are not limited thereto. That is, the following description may be equally applied to a case in which the number of light emitting structures D is less than 4 or exceeds 4.

Referring to FIG. 3, the light emitting module 100 includes the first to fourth light emitting devices 120 to 150, the turn-on controller 160, an external driving power supply 170, a fuse 176, and a rectifier 178. In the light emitting module 100 of FIG. 2, wire connection between the turn-on controller 160 and the external power input terminals 172 and 174, wire connection between the turn-on controller 160 and the first to fourth light emitting devices 120 to 150, and wire connection between the first to fourth light emitting devices 120 to 150 are not illustrated, and such wire connections are illustrated in FIG. 3.

The external driving power supply 170 supplies an alternating current (AC) signal as a driving voltage. In this regard, the AC signal may be an AC voltage Vac having an effective value of 100 V or 200V and a frequency of 50 Hz to 60 Hz.

The fuse 176 serves to protect the light emitting module 100 of FIG. 2 from an instantaneously high AC signal supplied from the external driving power supply 170. That is, when an instantaneously high AC signal is input, the fuse 176 is open to protect the light emitting module 100. For this operation, the fuse 176 may be disposed between the external driving power supply 170 and the rectifier 178.

The rectifier 178 may be a full-wave diode bridge circuit that rectifies an AC signal supplied from the external driving power supply 170 and converts the rectified AC signal into a ripple signal. The full-wave diode bridge circuit may include four bridge diodes BD1, BD2, BD3, and BD4. The full-wave diode bridge circuit is well known and thus a detailed description thereof will be omitted herein.

In this regard, the light emitting module 100 may further include a smoother (not shown) that implements smoothing of a ripple signal output from the rectifier 178 to convert the ripple signal into a direct current (DC) signal and outputs the DC signal obtained. The smoother may be disposed between the rectifier 178 and the turn-on controller 160 and between the rectifier 178 and each of the first to fourth light emitting devices 120 to 150.

The turn-on controller 160 increases the number of turn-ons of the first light emitting cells 122, 132, 142 and 152, the second light emitting cells 124, 134, 144 and 154, the third light emitting cells 126, 136, 146 and 156, and the fourth light emitting cells 128, 138, 148 and 158 of the respective first, second, third and fourth light emitting devices 120, 130, 140 and 150 as the level of a ripple signal increases in a phase range within which the level of the ripple signal increases from a low value to a high value. In addition, the turn-on controller 160 decreases the number of turn-ons of the first light emitting cells 122, 132, 142 and 152, the second light emitting cells 124, 134, 144 and 154, the third light emitting cells 126, 136, 146 and 156, and the fourth light emitting cells 128, 138, 148 and 158 of the respective first, second, third and fourth light emitting devices 120, 130, 140 and 150 as the level of the ripple signal decreases in a phase range within which the level of the ripple signal decreases from a high value to a low value.

For this operation, the turn-on controller 160 may include first to $N^{th}$ switches S1 to SN, e.g., first to fourth switches S1 to S4, and a switching controller 162. The turn-on controller 160 of FIG. 3 is provided only for illustrative purposes. That is, the turn-on controller 160 may have various circuit configurations so long as the turn-on controller 160 may control the first, second, third and fourth light emitting cells 122 to 128, 132 to 138, 142 to 148 and 152 to 158 to turn on and off according to variation in the level of ripple voltage.

Each of the first to fourth switches S1 to S4 is disposed between adjacent light emitting cells to form a path through which current flows in the adjacent light emitting cells. This will be described below in detail.

The first switch S1 is connected between a common reference potential 179 (e.g., a ground voltage) and a channel CH1 between adjacent first and second light emitting cells 122 and 124, 132 and 134, 142 and 144, and 152 and 154 of the respective first, second, third and fourth light emitting devices 120, 130, 140 and 150 and is switched under control of the switching controller 162 to form a path through which current flows from the first light emitting cells 122, 132, 142 and 152 to the second light emitting cells 124, 134, 144 and 154.

The second switch S2 is connected between the common reference potential 179 and a channel CH2 between adjacent second and third light emitting cells 124 and 126, 134 and 136, 144 and 146, and 154 and 156 of the respective first, second, third and fourth light emitting devices 120, 130, 140 and 150 and is switched under control of the switching controller 162 to form a path through which current flows from the second light emitting cells 124, 134, 144 and 154 to the third light emitting cells 126, 136, 146 and 156.

The third switch S3 is connected between the common reference potential 179 and a channel CH3 between adjacent third and fourth light emitting cells 126 and 128, 136 and 138, 146 and 148, and 156 and 158 of the respective first, second, third and fourth light emitting devices 120, 130, 140 and 150 and is switched under control of the switching controller 162 to form a path through which current flows from the third light emitting cells 126, 136, 146 and 156 to the fourth light emitting cells 128, 138, 148 and 158.

The fourth switch S4 is disposed between the common reference potential 179 and a channel CH4 of the fourth light emitting cells 128, 138, 148 and 158 of the respective first, second, third and fourth light emitting devices 120, 130, 140 and 150 and is switched under control of the switching controller 162 to form a path through which current flows from the fourth light emitting cells 128, 138, 148 and 158 to the common reference potential 179.

For this operation, each of the first to fourth switches S1 to S4 may be a bipolar transistor, a field effect transistor, or the like. When each of the first to fourth switches S1 to S4 is embodied as a bipolar transistor, a base of the bipolar transistor may be connected to a switching control signal output from the switching controller 162. In another embodiment, when each of the first to fourth switches S1 to S4 is embodied as a field effect transistor, a gate of the field effect transistor may be connected to a switching control signal output from the switching controller 162.

The switching controller 162 generates a switching control signal to control switching (i.e., opening/closing) of the first to fourth switches S1 to S4 according to the level of a ripple signal.

Although not shown, the light emitting module 100 may further include a current limit resistor, a voltage regulator, a clock generator, a resetter, and a counter.

The current limit resistor may be disposed between the switching controller 162 and each of the first to fourth switches S1 to S4, and the voltage regulator may regulate the level of a ripple signal to output the regulated ripple signal to the switching controller 162 and also be disposed between the rectifier 178 and the switching controller 162. In addition, the clock generator serves to supply a clock signal to the switching controller 162, and the reseller serves to reset operations of the switching controller 162 when power is shut off or input. The counter counts the number of clocks generated by the clock generator. The number of clocks counted by the counter and an instantaneous value of ripple voltage are matched with each other and stored, in the form of look-up table, in a storage unit (not shown) included in the switching controller 162. A time when an instantaneous value of voltage regulated by the voltage regulator reaches a minimum level MIN is a time when the counter begins a counting operation. This serves to allow the switching controller 162 to generate a signal to turn off a corresponding switch among the first to fourth switches S1 to S4 according to the number of clocks counted by the counter.

Hereinafter, operations of the turn-on controller 160 of the light emitting module 100 having configurations illustrated in FIG. 3 will be described with reference to the accompanying drawings. In this regard, it is described that the above-described ripple signal is a ripple voltage, but embodiments are not limited thereto.

Figure 4:
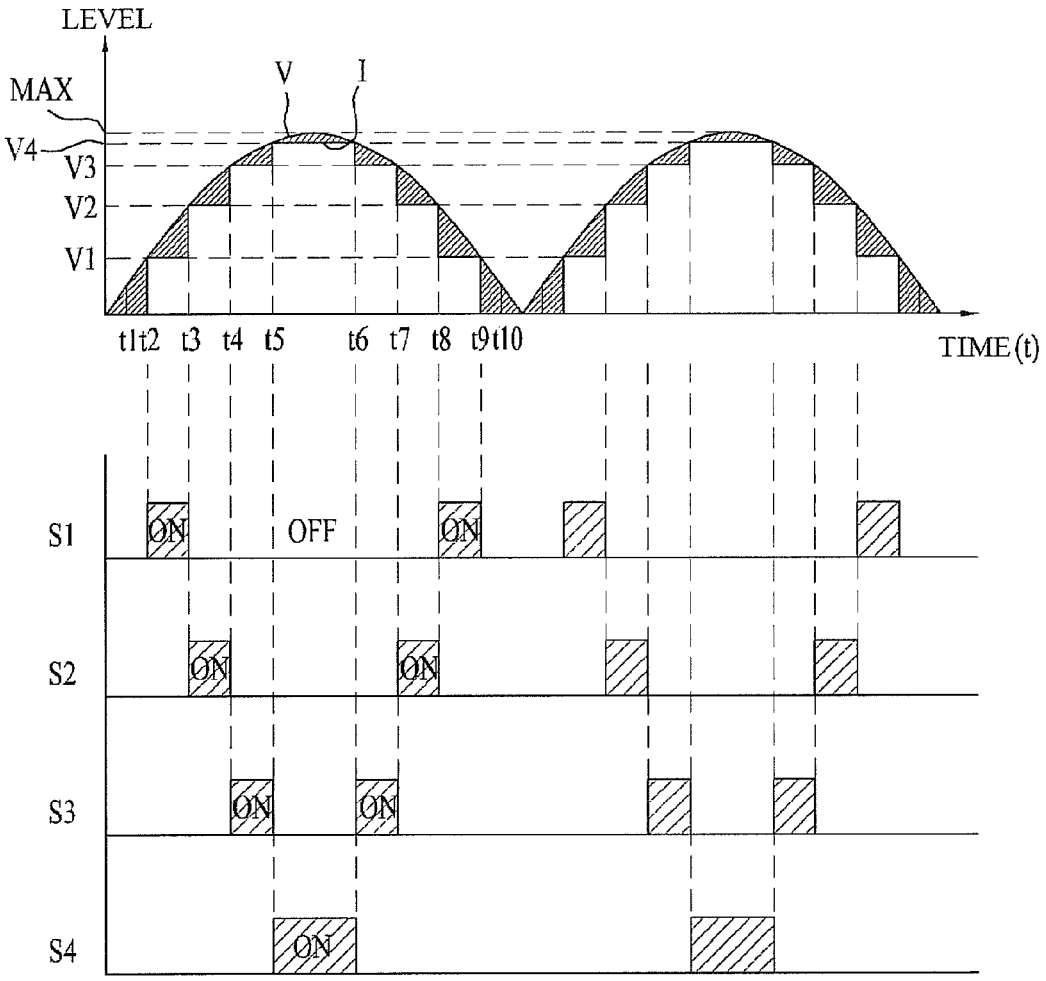
FIG. 4 is a waveform diagram of ripple voltage and ripple current for explaining operations of a turn-on controller of FIG. 3 to control first, second, third and fourth light emitting cells included in each of the first, second, third and fourth light emitting devices.

FIG. 4 is a waveform diagram of ripple voltage V and ripple current I for explaining operations of the turn-on controller 160 to control the first, second, third and fourth light emitting cells 122 to 128, 132 to 138, 142 to 148, and 152 to 158 respectively included in the first, second, third and fourth light emitting devices 120, 130, 140 and 150. Here, waveforms, shown below a plot of ripple voltage V and ripple current I, represent switching control signals output from the switching controller 162 to the corresponding switches. That is, if the switching control signal is "ON", the corresponding switch is turned on and, if the switching control signal is "OFF", the corresponding switch is turned off.

Referring to FIGS. 3 and 4, the first to fourth light emitting devices 120 to 150 may be set in such a way that the first light emitting cells 122, 132, 142 and 152 of the respective first, second, third and fourth light emitting devices 120, 130, 140 and 150 are turned on when a ripple voltage is V1 to less than V2, the second light emitting cells 124, 134, 144 and 154 of the respective first, second, third and fourth light emitting devices 120, 130, 140 and 150, in addition to the first light emitting cells 122, 132, 142 and 152, are also turned on when the ripple voltage is V2 to less than V3, the third light emitting cells 126, 136, 146 and 156 of the respective first, second, third and fourth light emitting devices 120, 130, 140 and 150, in addition to the first and second light emitting cells 122 and 124, 132 and 134, 142 and 144, and 152 and 154, are also turned on when the ripple voltage is V3 to less than V4, and all the first, second, third and fourth light emitting cells 122 to 128, 132 to 138, 142 to 148 and 152 to 158 of the respective first, second, third and fourth light emitting devices 120, 130, 140 and 150 are turned on when the ripple voltage is V4 or greater.

As such, the switching controller 162 switches the first to fourth switches S1 to S4 in response to a switching control signal such that the number of turn-ons of the first, second, third and fourth light emitting cells 122 to 128, 132 to 138, 142 to 148 and 152 to 158 increases according to variation in the level of ripple voltage in a phase range within which the ripple voltage increases from a low level to a high level.

In addition, the switching controller 162 switches the first to fourth switches S1 to S4 in response to a switching control signal such that the number of turn-ons of the first, second, third and fourth light emitting cells 122 to 128, 132 to 138, 142 to 148 and 152 to 158 decreases according to variation in the level of ripple voltage in a phase range within which the ripple voltage decreases from a high level to a low level.

First, in a state in which the switching controller 162 is reset by the resetter, the ripple voltage output from the rectifier 178 is output to the switching controller 162 and the first light emitting cells 122, 132, 142 and 152 of the respectively first, second, third and fourth light emitting devices 120, 130, 140 and 150. During this reset period, all of the first, second, third and fourth light emitting cells 122 to 128, 132 to 138, 142 to 148 and 152 to 158 of the respective first, second, third and fourth light emitting devices 120, 130, 140 and 150 are turned off. Switching the first to fourth switches S1 to S4 according to the level of ripple voltage by the switching controller 162 will be described below.

After reset, the switching controller 162 of the turn-on controller 160 turns off all of the first to fourth switches S1 to S4 when ripple voltage reaches a drive initiation value (time t1).

Thereafter, when ripple voltage reaches V1 (time t2), the switching controller 162 turns on only the first switch S1 and turns off all of the second, third and fourth switches S2, S3 and S4. Accordingly, the ripple voltage is applied to the first light emitting cells 122, 132, 142 and 152 of the respective first, second, third and fourth light emitting devices 120, 130, 140 and 150 and thus a current path is formed therein and, consequently, turn-on of only the first light emitting cells 122, 132, 142 and 152 of the respective first, second, third and fourth light emitting devices 120, 130, 140 and 150 is initiated.

Thereafter, when ripple voltage reaches V2 (time t3), the switching controller 162 turns on only the second switch S2 and turns off all of the first, third and fourth switches S1, S3 and S4. Accordingly, the ripple voltage is applied to the first and second light emitting cells 122 and 124, 132 and 134, 142 and 144, and 152 and 154 of the respective first, second, third and fourth light emitting devices 120, 130, 140 and 150 and thus a current path is formed therein and, consequently, all of the first and second light emitting cells 122 and 124, 132 and 134, 142 and 144, and 152 and 154 of the respective first, second, third and fourth light emitting devices 120, 130, 140 and 150 are turned on.

Thereafter, when ripple voltage reaches V3 (time t4), the switching controller 162 turns on only the third switch S3 and turns off the first, second and fourth switches S1, S2 and S4. Accordingly, the ripple voltage is applied to the first to third light emitting cells 122 to 126, 132 to 136, 142 to 146, and 152 to 156 of the respective first, second, third and fourth light emitting devices 120, 130, 140 and 150 and thus a current path is formed therein and, consequently, all of the first to third light emitting cells 122 to 126, 132 to 136, 142 to 146 and 152 to 156 of the respective first, second, third and fourth light emitting devices 120, 130, 140 and 150 are turned on.

Thereafter, when ripple voltage reaches V4 (time t5), the switching controller 162 turns on only the fourth switch S4 and turns off the first to third switches S1 to S3. Accordingly, the ripple voltage is applied to the first to fourth light emitting cells 122 to 128, 132 to 138, 142 to 148, and 152 to 158 of the respective first, second, third and fourth light emitting devices 120, 130, 140 and 150 and thus a current path is formed therein and, consequently, all of the first to fourth light emitting cells 122 to 128, 132 to 138, 142 to 148, and 152 to 158 of the respective first, second, third and fourth light emitting devices 120, 130, 140 and 150 are turned on.

Thereafter, when ripple voltage reaches a maximum level MAX and thereafter is reduced to V4 (time t6), the switching controller 162 turns on the third switch S3 and turns off the first, second and fourth switches S1, S2 and S4. Since the level of the ripple voltage is lower than V4, the fourth light emitting cells 128, 138, 148 and 158 of the respective first, second, third and fourth light emitting devices 120, 130, 140 and 150 are turned off, and only the first to third light emitting cells 122 to 126, 132 to 136, 142 to 146, and 152 to 156 of respective first, second, third and fourth light emitting devices 120, 130, 140 and 150 remain on.

Thereafter, when ripple voltage reaches V3 again (time t7), the switching controller 162 turns on only the second switch S2 and turns off the first, third and fourth switches S1, S3 and S4. Since the level of the ripple voltage is lower than V3, the third and fourth light emitting cells 126 and 128, 136 and 138, 146 and 148, and 156 and 158 of the respective first, second, third and fourth light emitting devices 120, 130, 140 and 150 are turned off, and only the first and second light emitting cells 122 and 124, 132 and 134, 142 and 144, and 152 and 154 of the respective first, second, third and fourth light emitting devices 120, 130, 140 and 150 remain on.

Thereafter, when ripple voltage reaches V2 again (time t8), the switching controller 162 turns on only the first switch S1 and turns off the second, third and fourth switches S2, S3 and S4. Since the level of the ripple voltage is lower than V2, the second to fourth light emitting cells 124 to 128, 134 to 138, 144 to 148, and 154 to 158 of the respective first, second, third and fourth light emitting devices 120, 130, 140 and 150 are turned off, and only the first light emitting cells 122, 132, 142 and 152 of the respective first, second, third and fourth light emitting devices 120, 130, 140 and 150 remain on.

Thereafter, when ripple voltage reaches V1 again (time t9), the level of the ripple voltage is lower than V1 and thus all of the first to fourth light emitting cells 122 to 128, 132 to 138, 142 to 148, and 152 to 158 of the respective first, second, third and fourth light emitting devices 120, 130, 140 and 150 are turned off.

As described above, the turn-on controller 160 sequentially turns on or turns off the first light emitting cells 122, 132, 142 and 152, the second light emitting cells 124, 134, 144 and 154, the third light emitting cells 126, 136, 146 and 156, and the fourth light emitting cells 128, 138, 148 and 158 of the respective first, second, third and fourth light emitting devices 120, 130, 140 and 150 according to the level of the ripple voltage.

As such, according to the embodiment assuming that M=N=4, the first to fourth light emitting devices 120 to 150 are respectively divided into the first to fourth light emitting cells 122 to 128, 132 to 138, 142 to 148, and 152 to 158, and the $n^{th}$ light emitting cells 122, 132, 142 and 152, 124, 134, 144 and 154, 126, 136, 146 and 156, and 128, 138, 148, and 158 of the respective first, second, third and fourth light emitting devices 120, 130, 140 and 150 are connected to one another in parallel and are thus simultaneously turned on or turned off. Accordingly, when the level of the ripple voltage increases or decrease, the first to fourth light emitting devices 120 to 150 illustrated in FIG. 2 may exhibit the same brightness. That is, the first light emitting cells 122, 132, 142 and 152, the second light emitting cells 124, 134, 144 and 154, the third light emitting cells 126, 136, 146 and 156, and the fourth light emitting cells 128, 138, 148 and 158 of the respective first, second, third and fourth light emitting devices 120, 130, 140 and 150 are simultaneously turned on or turned off. Therefore, the light emitting module 100 according to the embodiment may have enhanced uniformity ratio of illumination and the first to fourth light emitting devices 120 to 150 thereof may consume constant power.

Hereinafter, the first, second, third and fourth light emitting devices 120, 130, 140 and 150 illustrated in FIGS. 2 and 3 will be described with reference to the accompanying drawings. In this regard, as described above, it is assumed that the number of the light emitting structures D included in each of the first, second, third and fourth light emitting devices 120, 130, 140 and 150 is 16, the number of light emitting cells in each of the first, second, third and fourth light emitting devices 120, 130, 140 and 150 is 4, and each light emitting cell includes four light emitting structures D.

Figure 5:
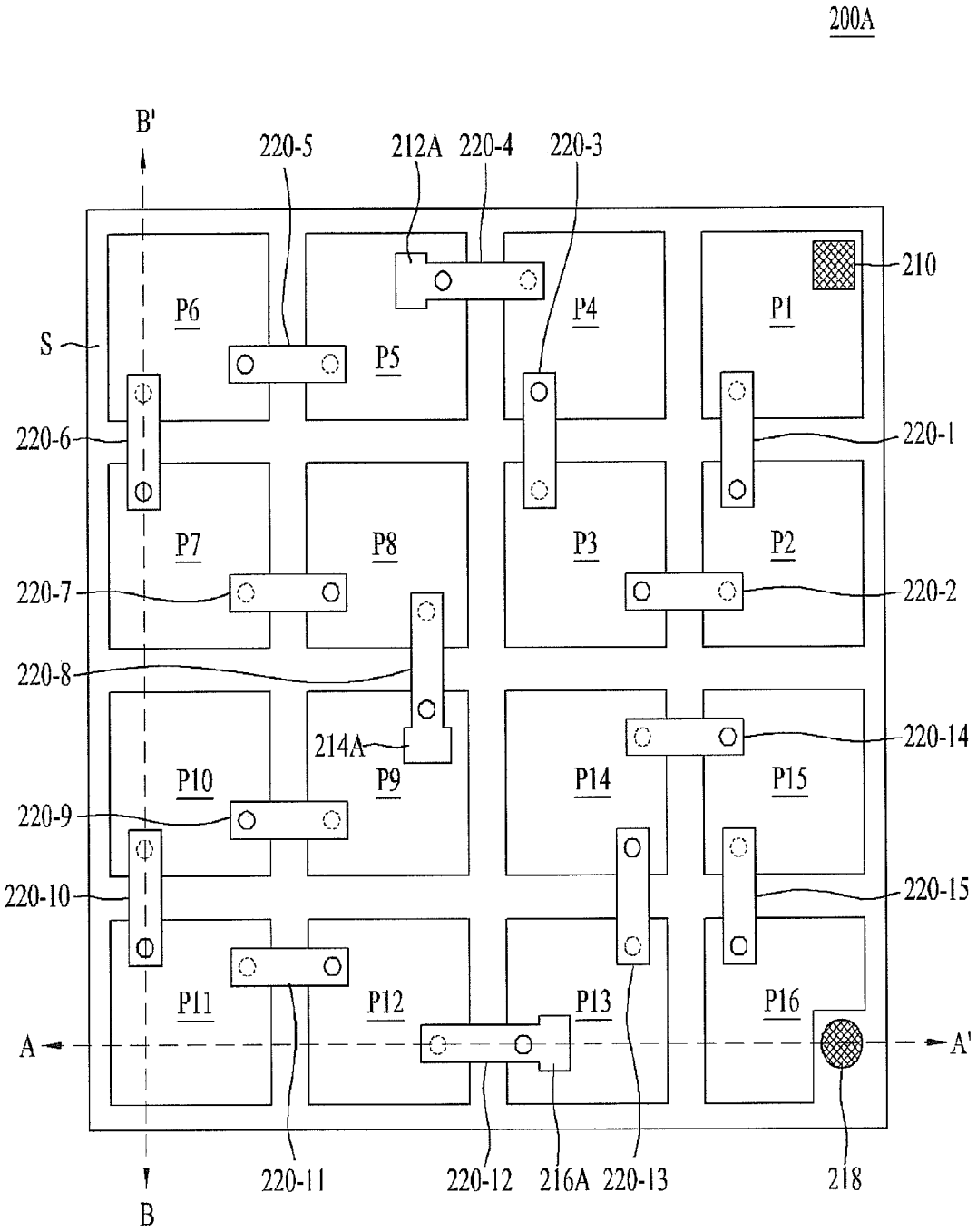
FIG. 5 is a plan view of a light emitting device according to an embodiment.
Figure 6:
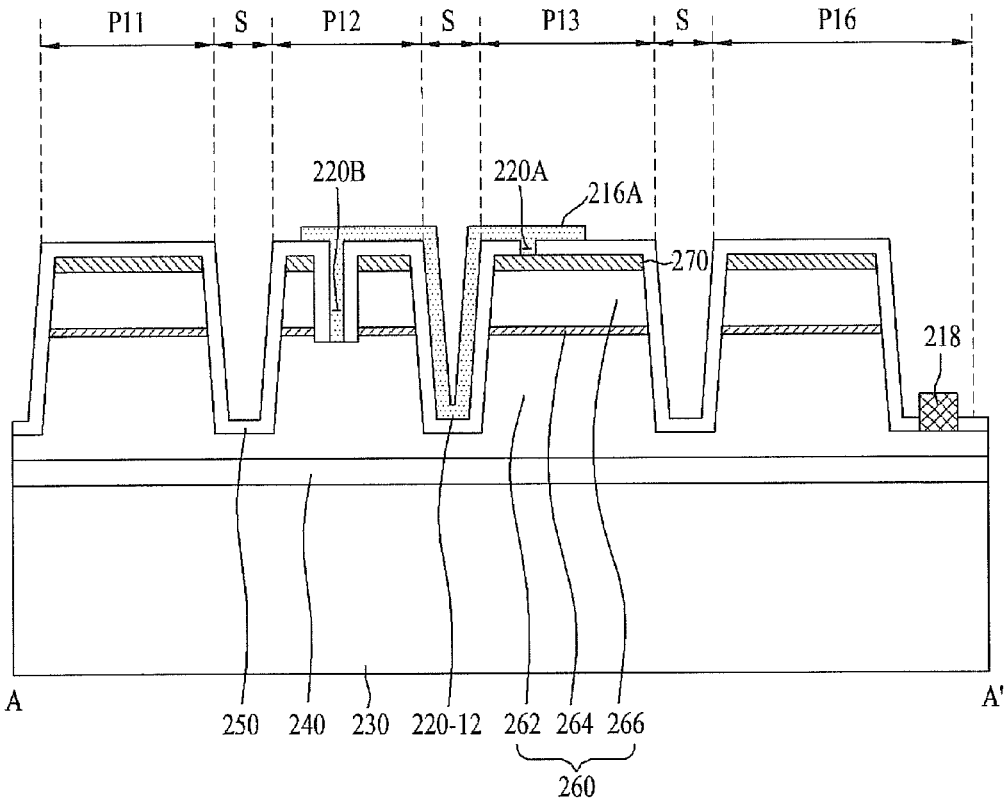
FIG. 6 is a sectional view taken along line A-A' of FIG. 5.
Figure 7:
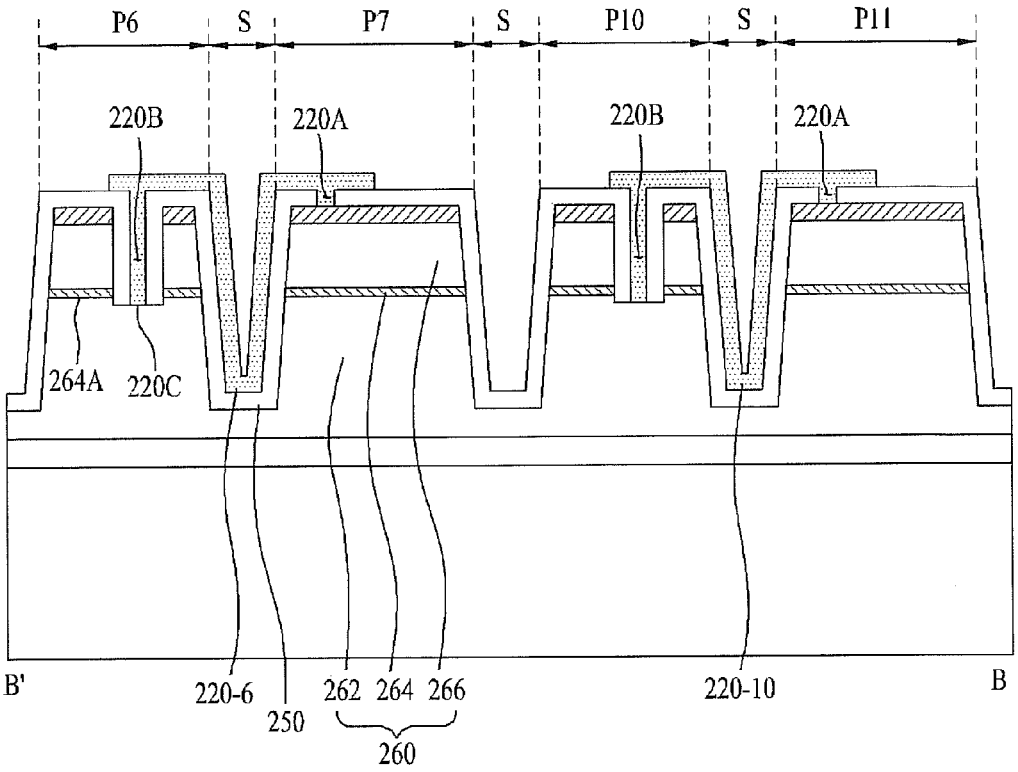
FIG. 7 is a sectional view taken along line B-B' of FIG. 5.

FIG. 5 is a plan view of a light emitting device 200A according to an embodiment. FIG. 6 is a sectional view taken along line A-A' of FIG. 5. FIG. 7 is a sectional view taken along line B-B' of FIG. 5.

The light emitting device 200A of FIG. 5 corresponds to each of the first, second, third and fourth light emitting devices 120, 130, 140 and 150 illustrated in FIGS. 2 and 3.

Referring to FIGS. 5 to 7, the light emitting device 200A includes a first electrode part 210, at least one intermediate pad (e.g., 212A, 214A and 216A), a second electrode part 218, connection electrodes 220-1 to 220-I, wherein I is a natural number of 1 or more (lum), a substrate 230, a buffer layer 240, an insulating layer 250, a plurality of light emitting structures 260 defined as a plurality of light emitting regions P1 to PJ, wherein J>1 and J=I+1 (here, J is a natural number), and a conductive layer 270.

The substrate 230 may be formed of a material suitable for growth of semiconductor materials, e.g., a carrier wafer. In addition, the substrate 230 may be formed of a material with excellent thermal conductivity and may be a conductive substrate or an insulating substrate. For example, the substrate 130 may be made of at least one material selected from among sapphire ($Al_2O_3$), GaN, SiC, ZnO, Si, GaP, InP, $Ga_2O_3$, and GaAs. The substrate 230 may be provided at an upper surface thereof with an uneven patterned portion (not shown).

The buffer layer 240 is disposed between the substrate 230 and the light emitting structures 260 and may be formed using a Group III-V compound semiconductor. The buffer layer 240 reduces a difference in lattice constant between the substrate 230 and the light emitting structures 260.

The light emitting structures 260 may be semiconductor layers that emit light and each light emitting structure 260 may include a first conductive type semiconductor layer 262, an active layer 264, and a second conductive type semiconductor layer 266. The light emitting structure 260 may have a structure in which the first conductive type semiconductor layer 262, the active layer 264, and the second conductive type semiconductor layer 266 are sequentially stacked on the substrate 230.

The first conductive type semiconductor layer 262 may be formed of a semiconductor compound. The first conductive type semiconductor layer 262 may be formed of a Group III-V or II-VI compound semiconductor and doped with a first conductive type dopant.

For example, the first conductive type semiconductor layer 262 may include a semiconductor having the formula of $In_xAl_yGa_{1-x-y}N$, wherein $0 \le x \le 1$, $0 \le y \le 1$, and $0 \le x+y \le 1$. For example, the first conductive type semiconductor layer 262 may include any one of InAlGaN, GaN, AlGaN, InGaN, AlN, and InN and be doped with an n-type dopant (e.g., Si, Ge, Sn, or the like).

The active layer 264 is disposed between the first conductive type semiconductor layer 262 and the second conductive type semiconductor layer 266 and may generate light by energy produced through recombination of electrons and holes respectively supplied from the first conductive type semiconductor layer 262 and the second conductive type semiconductor layer 266.

The active layer 264 may be formed of a semiconductor compound, for example, a Group III-V or II-VI compound semiconductor and include a double hetero structure, a single well structure, a multi-well structure, a quantum wire structure, a quantum dot structure, or the like.

When the active layer 264 has a quantum well structure, for example, the active layer 264 may have a single or multi quantum well structure including a well layer formed of a compound having the formula of $In_xAl_yGa_{1-x-y}N$ where $0 \le x \le 1$, $0 \le y \le 1$ and $0 \le x+y \le +y$here $0 \le x \le 1$, $0 \le y \le 1$ and $0 \le$as a quantum well structure, for example, $_aAl_bGa_{1-a-b}N$ where $0 \le x \le 1$, $0 \le y \le 1$ and $0 \le a+b \le +b$heThe well layer may be formed of a material having a lower energy band gap than that of the barrier layer.

The second conductive type semiconductor layer 266 may be formed of a semiconductor compound. The second conductive type semiconductor layer 266 may be formed of a Group III-V compound semiconductor, a Group II-VI compound semiconductor, or the like and doped with a second conductive type dopant.

For example, the second conductive type semiconductor layer 266 may include a semiconductor material having the formula of $In_xAl_yGa_{1-x-y}N$ where $0 \le x \le 1$, $0 \le y \le 1$, and $0 \le x+y \le 1$. For example, the second conductive type semiconductor layer 266 may include any one of GaN, AlN, AlGaN, InGaN, InN, InAlGaN, AlInN, AlGaAs, GaP, GaAs, GaAsP, and AlGaInP and be doped with a p-type dopant (e.g., Mg, Zn, Ca, Sr, or Ba).

The first conductive type semiconductor layer 262 of the light emitting structure 260 may be partially exposed. That is, the second conductive type semiconductor layer 266, the active layer 264, and the first conductive type semiconductor layer 262 may be partially etched to expose a portion of the first conductive type semiconductor layer 262. In this regard, an exposed surface of the first conductive type semiconductor layer 262, exposed by mesa etching, may be disposed lower than a lower surface of the active layer 264.

A conductive clad layer (not shown) may be disposed between the active layer 264 and the first conductive type semiconductor layer 262 or between the active layer 264 and the second conductive type semiconductor layer 266 and formed of a nitride semiconductor (e.g., AlGaN).

The light emitting structure 260 may further include a third conductive type semiconductor layer (not shown) below the second conductive type semiconductor layer 266, and the third conductive type semiconductor layer may have a conductive type opposite that of the second conductive type semiconductor layer 266.

The first conductive type semiconductor layer 262 may be of an n-type and the second conductive type semiconductor layer 266 may be of a p-type and, in another embodiment, the first conductive type semiconductor layer 262 may be of a p-type and the second conductive type semiconductor layer 266 may be of an n-type. Accordingly, the light emitting structure 260 may include at least one of an n-p junction structure, a p-n junction structure, an n-p-n junction structure, or a p-n-p junction structure.

The light emitting structures 260 may include a plurality of light emitting regions P1 to PJ spaced apart from one another and boundary regions S. In this regard, the boundary regions S may be regions disposed between the light emitting regions P1 to PJ. In another embodiment, the boundary regions S may be regions disposed around the respective light emitting regions P1 to PJ. The boundary regions S may include a region in which the first conductive type semiconductor layer 262 is partially exposed by mesa-etching the light emitting structures 260 in order to define the light emitting structures 260 as the light emitting regions P1 to PJ.

The light emitting structures 260 formed as a single chip respectively correspond to the light emitting regions P1 to PJ defined by the boundary regions S. For example, first to sixteenth light emitting regions P1 to P16 of FIG. 5 may correspond to 16 light emitting structures included in the first, second, third or fourth light emitting device 120, 130, 140 or 150 of FIG. 3.

The conductive layer 270 is disposed on the second conductive type semiconductor layer 266. The conductive layer 270 may reduce total reflection and is highly optically transmissive and thus may increase extraction efficiency of light emitted from the active layer 264 to the second conductive type semiconductor layer 266. The conductive layer 270 may be formed as a single layer or multiple layers using at least one of oxide-based materials that have high transmittance with respect to luminescence wavelengths and are transparent, e.g., indium tin oxide (ITO), tin oxide (TO), indium zinc oxide (IZO), indium zinc tin oxide (IZTO), indium aluminum zinc oxide (IAZO), indium gallium zinc oxide (IGZO), indium gallium tin oxide (IGTO), aluminum zinc oxide (AZO), aluminum tin oxide (ATO), gallium zinc oxide (GZO), $IrO_x$, $RuO_x$, $RuO_x$/ITO, Ni, Ag, Ni/$IrO_x$/Au, or Ni/$IrO_x$/Au/ITO.

The insulating layer 250 is disposed on the light emitting regions P1 to PJ and the boundary regions S. The insulating layer 250 may be formed of an optically transmissive and insulating material, e.g., $SiO_2$, $SiO_x$, $SiO_xN_y$, $Si_3N_4$, or $Al_2O_3$. For example, the insulating layer 250 may cover upper and side surfaces of the light emitting regions P1 to PJ and the boundary regions S.

The first electrode part 210 is disposed on the second conductive type semiconductor layer 266 or the conductive layer 270 of any one (e.g., the first light emitting region P1) of the light emitting regions P1 to PJ.

The first electrode part 210 may contact the second conductive type semiconductor layer 266 or the conductive layer 270. For example, the first electrode part 210 may contact the conductive layer 270 of the first light emitting region P1 of the light emitting regions connected to one another in series (e.g., first to twelfth light emitting regions P1 to P12).

The first electrode part 210 may include a first pad bounded with a wire (not shown) for supplying first power. For example, the first electrode part 210 may be disposed on the insulating layer 250 and have a portion contacting the conductive layer 270 by penetrating the insulating layer 250.

The second electrode part 218 may be disposed on the first conductive type semiconductor layer 262 of any one (e.g., the sixteenth light emitting region P16) of the light emitting regions P1 to PJ and contact the first conductive type semiconductor layer 262. The second electrode part 218 may include a second pad bonded with a wire (not shown) for supplying second power. In the embodiment illustrated in FIG. 5, the second electrode part 218 may serve as a second pad.

The series-connected light emitting regions P1 to PJ of the light emitting device 200A are referred to as, in ascending order, first to $J^{th}$ light emitting regions. That is, a light emitting region where the first electrode part 210 is located is referred to as a first light emitting region P1, and a light emitting region where the second electrode part 218 is located is referred to as a $J^{th}$ light emitting region PJ.

The connection electrodes 220-1 to 220-I are disposed on the insulating layer 250 and electrically connect the first to $J^{th}$ light emitting regions P1 to PJ in series. For example, the connection electrodes 220-1 to 220-I may connect the first to $J^{th}$ light emitting regions P1 to PJ in series, starting from the first light emitting region P1 in which the first electrode part 210 is disposed and ending at the $J^{th}$ light emitting region PJ in which the second electrode part 218 is disposed.

For example, an $i^{th}$ connection electrode 220-*i* where 1 connection electrode 220-*i* where $1 \le hi^{th}$ and $i+1^{th}$ light emitting regions Pi and Pi+1, in particular, the first conductive type semiconductor layer 262 of the $i^{th}$ light emitting region Pi and the conductive layer 270 of the $i+1^{th}$ light emitting region Pi+1. In another embodiment in which the conductive layer 270 is omitted, the $i^{th}$ connection electrode 220-I may electrically connect the first conductive type semiconductor layer 262 of the $i^{th}$ light emitting region Pi to the second conductive type semiconductor layer 266 of the $i+1^{th}$ light emitting region Pi+1.

Referring to FIGS. 5 to 7, the $i^{th}$ connection electrode 220-*i* may be disposed on the $i^{th}$ light emitting region Pi, the $i+1^{th}$ light emitting region Pi+1, and the boundary region S therebetween. In addition, the $i^{th}$ connection electrode 220-*i* may have at least one first part 220A contacting the conductive layer 270 (or the second conductive type semiconductor layer 266) of the i+1$^{th}$ light emitting region Pi+1 by penetrating the insulating layer 250. Circles represented by solid lines illustrated in FIG. 5 denote the first parts 220A of the connection electrodes 220-1 to 220-I. The insulating layer 250 may be disposed between the light emitting structures 260 and the connection electrodes 220-1 to 220-I, in the boundary regions S.

In addition, the i$^{th}$ connection electrode 220-*i* may have at least one second part 220B contacting the first conductive type semiconductor layer 262 by penetrating the insulating layer 250, the conductive layer 270, the second conductive type semiconductor layer 266, and the active layer 264 of the i$^{th}$ light emitting region Pi. Circles represented by dotted lines illustrated in FIG. 5 denote the second parts 220B of the connection electrodes 220-1 to 220-I.

In this regard, the insulating layer 250 may be disposed between the connection electrodes 220-1 to 220-I and the conductive layer 270, between the second parts 220B of the connection electrodes 220-1 to 220-I and the second conductive type semiconductor layer 266, and between the second parts 220B of the connection electrodes 220-1 to 220-I and the active layer 264.

The insulating layer 250 may electrically separate the i$^{th}$ connection electrode 220-*i* from the conductive layer 270, the second conductive type semiconductor layer 266, and the active layer 264 of the i$^{th}$ light emitting region Pi. For example, referring to FIG. 7, the insulating layer 250 may serve to electrically separate the sixth connection electrode 220-6 from the conductive layer 270, the second conductive type semiconductor layer 266, and the active layer 264 of the sixth light emitting region P6.

A lower surface 220C of the second part 220B of the i$^{th}$ connection electrode 220-*i* may be disposed below a lower surface 264A of the active layer 264. The second parts 220B may take the form of a hole or groove filled with an electrode material.

Meanwhile, assuming that the number of light emitting structures included in light emitting cells is k (k=4 in FIG. 3), the intermediate pads 212A, 214A and 216A may be disposed in k+1$^{th}$, 2k+1$^{th}$, . . . and (N−1)k+1$^{th}$ light emitting regions. In this regard, N represents the number of light emitting cells included in each light emitting device. Referring to FIGS. 3 and 5, since N=k=4, the intermediate pads 212A, 214A and 216A may be respectively disposed in the fifth, ninth and thirteenth light emitting regions P5, P9 and P13. The intermediate pads 212A, 214A and 216A may be disposed on the insulating layer 250 and electrically connected to the second conductive type semiconductor layer 266 or the conductive layer 270. The intermediate pads 212A, 214A and 216A may be regions respectively connected to the channels CH1, CH2 and CH3 illustrated in FIG. 3.

In addition, the insulating layer 250 may be disposed between the intermediate pads 212A, 214A and 216A and the conductive layer 270, and the intermediate pads 212A, 214A and 216A may be connected to the connection electrodes 220-4, 220-8 and 220-12 disposed in the same light emitting regions (e.g., the fifth, ninth and thirteenth light emitting regions P5, P9 and P13). For example, referring to FIG. 6, the first intermediate pad 216A disposed on the insulating layer 250 of the thirteenth light emitting region P13 may be connected to an end of the twelfth connection electrode 220-12, disposed in the same light emitting region, i.e., the thirteenth light emitting region P13.

Figure 8:
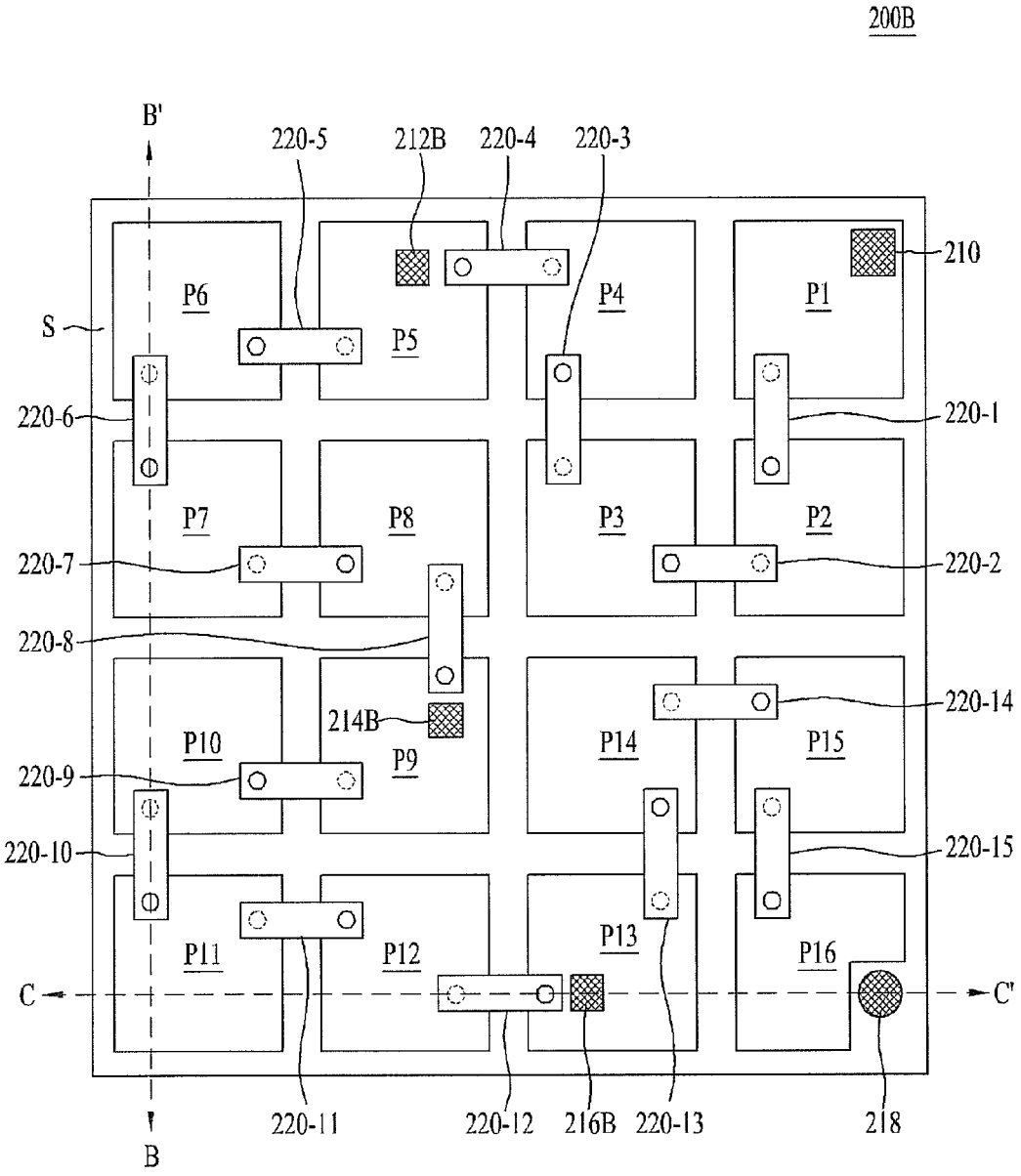
FIG. 8 is a plan view of a light emitting device according to another embodiment.
Figure 9:
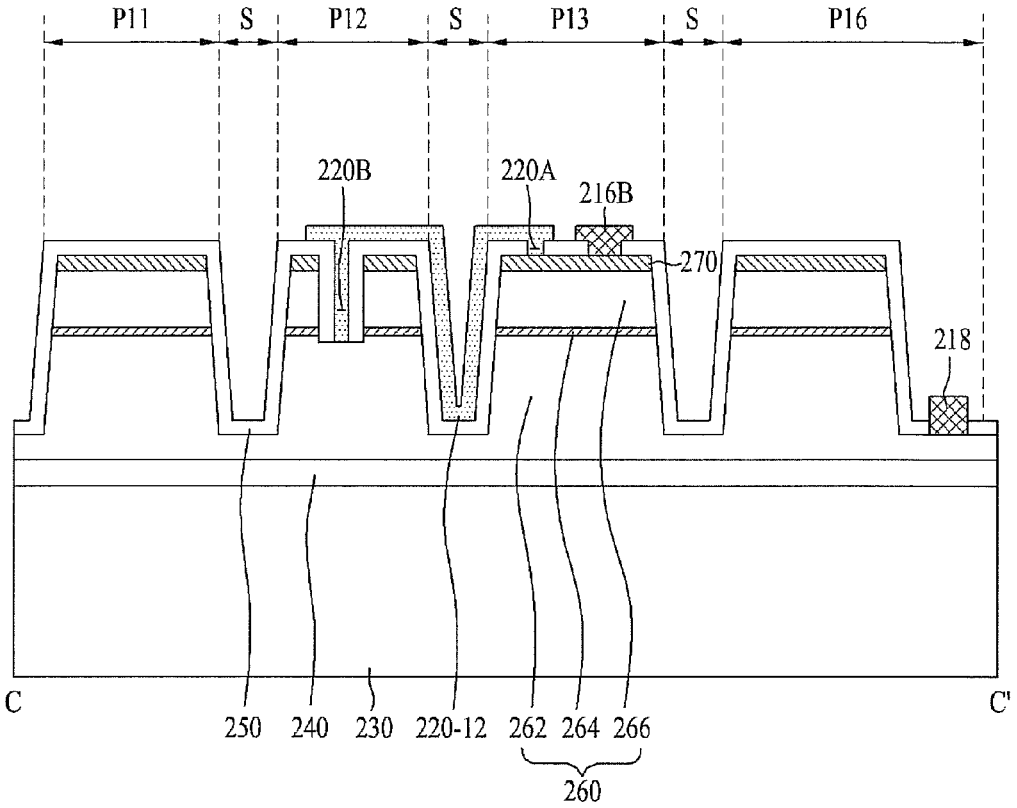
FIG. 9 is a sectional view taken along line C-C' of FIG. 8.

FIG. 8 is a plan view of a light emitting device 200B according to another embodiment. FIG. 9 is a sectional view taken along line C-C' of FIG. 8.

According to another embodiment, a portion of intermediate pads 212B, 214B and 216B may be directly connected to the conductive layer 270 by penetrating the insulating layer 250. In this regard, an intermediate pad and a connection electrode disposed in the same light emitting region may be electrically connected indirectly to each other through the conductive layer 270. For example, referring to FIG. 8, the intermediate pad 212B and the connection electrode 220-4 is electrically connected indirectly to each other via the conductive layer 270. The intermediate pad 214B and the connection electrode 220-8 are electrically connected indirectly to each other via the conductive layer 270. The intermediate pad 216B and the connection electrode 220-12 are electrically connected indirectly to each other via the conductive layer 270. Referring to FIG. 9, a portion of the intermediate pad 216B is electrically connected directly to the conductive layer 270 by penetrating the insulating layer 250. As such, the intermediate pad 216B and the twelfth connection electrode 220-12 disposed in the same light emitting region, i.e., the thirteenth light emitting region P13 may be electrically connected indirectly to each other via the conductive layer 270. Except for this difference, the light emitting device 200B of FIG. 8 includes the same elements as those of the light emitting device 200A of FIG. 5 and the light emitting device 200B of FIG. 9 includes the same elements as those of the light emitting device 200A of FIG. 6 and thus like elements denote like reference numerals throughout the drawings. Thus, a detailed description thereof will be omitted herein.

Figure 10:
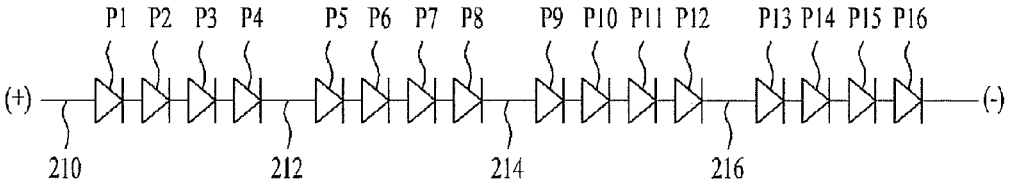
FIG. 10 is a circuit diagram of the light emitting device of FIG. 5 or 8.

FIG. 10 is a circuit diagram of the light emitting device 200A of FIG. 5 or the light emitting device 200B of FIG. 8. Referring to FIGS. 5, 8 and 10, each of the light emitting devices 200A and 200B may have a common single negative (−) terminal, e.g., a single second pad 218, and at least two positive (+) terminals, e.g., a first pad 210 and at least one of the intermediate pads 212, 214 or 216. In this regard, the intermediate pad 212 corresponds to the intermediate pads 212A and 212B illustrated in FIGS. 5 and 8, the intermediate pad 214 corresponds to the intermediate pads 214A and 214B illustrated in FIGS. 5 and 8, and the intermediate pad 216 corresponds to the intermediate pads 216A and 216B illustrated in FIGS. 5 and 8.

The first pad 210 is connected to the rectifier 178 of FIG. 3, the intermediate pads 212, 214 and 216 are respectively connected to the channels CH1, CH2 and CH3, and the second pad 218 is connected to the channel CH4.

The first to J$^{th}$ light emitting regions P1 to PJ are sequentially connected in series by the first to I$^{th}$ connection electrodes 220-1 to 220-I. That is, the first to J$^{th}$ light emitting regions P1 to PJ may be sequentially connected in series, staring from the first light emitting region P1 in which the first electrode part 210 is disposed to the J$^{th}$ light emitting region PJ in which the second electrode part 218 is disposed.

The sequentially series-connected first to J$^{th}$ light emitting regions P1 to PJ may be defined as light emitting regions of the first to N$^{th}$ light emitting cells. In this regard, the first to J$^{th}$ light emitting regions P1 to PJ may be included in different light emitting cells. Referring to FIG. 3, in each of the light emitting devices 120, 130, 140 and 150, light emitting regions (e.g., first to fourth light emitting regions P1 to P4) may be included in the first light emitting cells 122, 132, 142 and 152, and light emitting regions (e.g., fifth to eighth light emitting regions P5 to P8) may be included in the second light emitting cells 124, 134, 144 and 154, light emitting regions (e.g., ninth to twelfth light emitting regions P9 to P12) may be included in the third light emitting cells 126, 136, 146 and 156, and light emitting regions (e.g., thirteenth to sixteenth light emitting regions P13 to P16) may be included in the fourth light emitting cells 128, 138, 148 and 158.

The light emitting regions respectively included in the light emitting cells 122 to 128, 132 to 138, 142 to 148, and 152 to 158 may be connected to each other in series by the connection electrodes 220-1 to 220-I or the intermediate pads 212, 214 and 216.

The light emitting regions included in the same light emitting cell are simultaneously driven or not driven and thus, when any one of the light emitting cells is driven, uniform current distribution is formed in the light emitting regions of the corresponding driven light emitting cell. Thus, to increase luminous efficacy, the light emitting regions of the same light emitting cell may have the same area.

An optical member such as a light guide plate, a prism sheet, a diffusion sheet, a fluorescent sheet, or the like may be disposed on an optical path of light emitted from the light emitting module according to the embodiment. The light emitting module and the optical member may function as a backlight unit or a lighting unit. For example, a lighting system may include a backlight unit, a lighting unit, an indicating device, lamps, street lamps, and the like.

Figure 11:
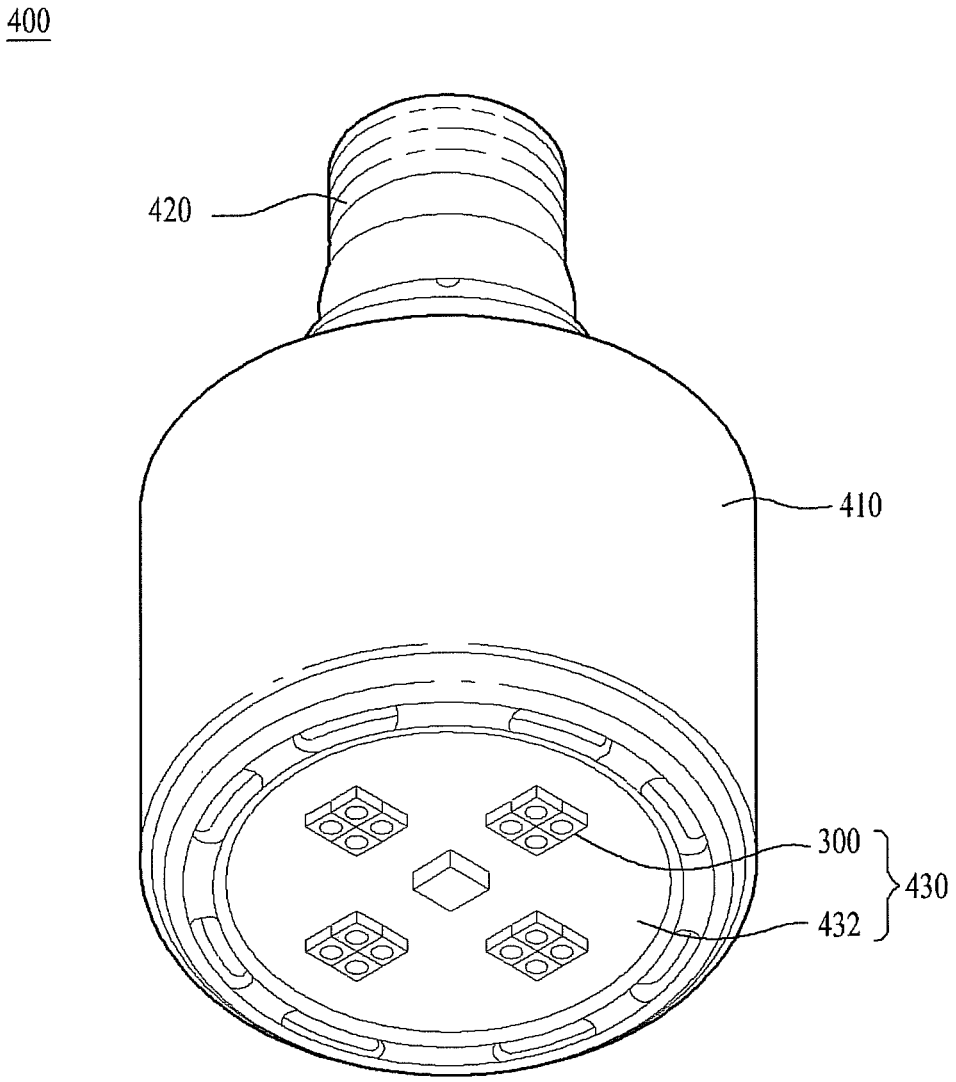
FIG. 11 is a perspective view of a lighting unit according to an embodiment.

FIG. 11 is a perspective view showing a lighting unit 400 according to an embodiment. The lighting unit 400 of FIG. 11 is given as one example of a lighting system and embodiments are not limited thereto.

In the embodiment, the lighting unit 400 may include a case body 410, a connection terminal 420 installed at the case body 410 to receive power from an external power supply, and a light emitting module unit 430 installed at the case body 410.

The case body 410 may be formed of a material having good heat dissipation characteristics. For instance, the case body 410 may be formed of a metal or a resin.

The light emitting module unit 430 may include a board 432, and at least one light emitting device 300 mounted on the board 432.

The board 432 may be formed by printing a circuit pattern on an insulator. For instance, the board 432 may include a general printed circuit board (PCB), a metal core PCB, a flexible PCB, a ceramic PCB, and the like.

In addition, the board 432 may be formed of a material to effectively reflect light, or the board 432 may have a colored surface to effectively reflect light, e.g., a white or silver surface.

The at least one light emitting device 300 may be mounted on the board 432. The light emitting module unit 430 may correspond to the light emitting module 100 of FIG. 2 or 3, the board 432 may correspond to the body 110 of FIG. 2, and the light emitting device 300 may correspond to one of the light emitting devices 120, 130, 140, 150, 200A and 200B illustrated in FIGS. 2 and 5 to 9.

The light emitting module unit 430 may be a combination of various light emitting devices 300 to acquire desired color and brightness. For instance, to acquire a high color rendering index (CRI), white, read, and green light emitting diodes may be disposed in combination.

The connection terminal 420 may be electrically connected to the light emitting module unit 430 to supply power. In the embodiment, the connection terminal 420 is spirally fitted and coupled to an external power supply in a socket coupling manner, but embodiments are not limited thereto. For instance, the connection terminal 420 may take the form of a pin to be inserted into an external power supply, or may be connected to an external power supply via a wiring.

As is apparent from the above description, according to a light emitting module according to an embodiment, each of first to $M^{th}$ (wherein, M is an integer of 2 or greater) light emitting devices is divided into first to $N^{th}$ (wherein, N is an integer of 2 or greater, $1 \le n \le N$) light emitting cells to simultaneously turn on or turn off an $n^{th}$ light emitting cell of each light emitting device. Thus, all the light emitting devices exhibit a constant level of brightness regardless of the level of power applied from the outside and thus uniformity ratio of illumination is enhanced and each light emitting device has constant power consumption.

Embodiments provide a light emitting module with constant uniformity ratio of illumination and power consumption and a lighting unit including the same.

In one embodiment, a light emitting module includes a body, first to $M^{th}$ (wherein, M is an integer of 2 or greater) light emitting devices disposed on the body to be spaced apart from each other, and a turn-on controller controlling the first to $M^{th}$ light emitting devices to turn on, wherein an $M^{th}$ ($1 \le m \le M$) light emitting device among the first to $M^{th}$ light emitting devices comprises first to $N^{th}$ (wherein, N is an integer of 2 or greater) light emitting cells connected to each other in series, wherein an $n^{th}$ ($1 \le n \le N$) light emitting cell among the first to $N^{th}$ light emitting cells comprises at least one light emitting structure, and the turn-on controller simultaneously turns on or turns off the $n^{th}$ light emitting cells of the first to $M^{th}$ light emitting devices.

The turn-on controller may control the first to $M^{th}$ light emitting devices to turn on and off according to level of a driving voltage applied from the outside.

The turn-on controller may sequentially turn on or turn off the first to $N^{th}$ light emitting cells according to the level of a driving voltage.

The $n^{th}$ light emitting cells of the first to $M^{th}$ light emitting devices may be connected to each other in parallel.

The first to $M^{th}$ light emitting devices may be disposed on the body to be spaced apart by an equal distance from each other.

The first to $M^{th}$ light emitting devices may be disposed on the body to be spaced apart by different distances from each other.

A separation distance between the first to $M^{th}$ light emitting devices may be between 72° and 120°, for example, 72°, 90°, or 120°.

The first to $M^{th}$ light emitting devices may be radially disposed on the body.

The first to $M^{th}$ light emitting devices may be disposed with the turn-on controller as a center.

The turn-on controller may include first to $M^{th}$ switches disposed between adjacent ones of the first to $N^{th}$ light emitting cells and forming a path through which current flows in the adjacent light emitting cells and a switching controller controlling switching of the first to $M^{th}$ switches according to the level of the driving voltage.

M=N=4.

The first to $N^{th}$ light emitting cells of each of the first to $M^{th}$ light emitting devices may be disposed so as to contact each other.

The first to $N^{th}$ light emitting cells of each of the first to $M^{th}$ light emitting devices may be disposed an equal distance from each other.

The turn-on controller may be disposed at a center or edge portion of the body.

Light emitting regions of the light emitting structures of the $n^{th}$ light emitting cells of the first to $M^{th}$ light emitting devices may have the same area.

In another embodiment, a light emitting module includes a body, first to $M^{th}$ (wherein, M is an integer of 2 or greater) light emitting devices disposed on the body to be spaced apart from each other, a rectifier rectifying an alternating current signal applied from the outside to convert the alternating current signal into a ripple signal, and a turn-on controller controlling the first to $M^{th}$ light emitting devices to turn on according to the level of the ripple signal, wherein an $m^{th}$ ($1 \leq m \leq M$) light emitting device among the first to $M^{th}$ light emitting devices includes first to $N^{th}$ (wherein, N is an integer of 2 or greater) light emitting cells connected to each other in series, and the turn-on controller simultaneously turns on or turns off $n^{th}$ light emitting cells of the first to $M^{th}$ light emitting devices.

In another embodiment, a lighting unit includes a case body, a connection terminal installed at the case body and receiving power, and the light emitting module installed at the case body.

Any reference in this specification to "one embodiment," "an embodiment," "example embodiment," etc., means that a particular feature, structure, or characteristic described in connection with the embodiment is included in at least one embodiment of the application. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A light emitting module, comprising:

a body;

first to $M^{th}$ (wherein, M is an integer of 2 or greater) light emitting devices provided on the body to be spaced apart from each other; and a turn-on controller controlling the first to $M^{th}$ light emitting devices to turn on, wherein an $m^{th}$ ($1 \leq m \leq M$) light emitting device among the first to $M^{th}$ light emitting devices comprises first to $N^{th}$ (wherein, N is an integer of 2 or greater) light emitting cells connected to each other in series, wherein an $n^{th}$ ($1 \leq n \leq N$) light emitting cell among the first to $N^{th}$ light emitting cells comprises at least one light emitting structure, wherein the turn-on controller simultaneously turns on or turns off the $n^{th}$ light emitting cells of the first to $M^{th}$ light emitting devices, and wherein the first to $N^{th}$ light emitting cells of each of the first to $M^{th}$ light emitting devices are provided to contact each other.

2. The light emitting module according to claim 1, wherein the turn-on controller controls the first to $M^{th}$ light emitting devices to turn on and off according to level of a driving voltage applied from the outside.

3. The light emitting module according to claim 2, wherein the turn-on controller sequentially turns on or turns off the first to $N^{th}$ light emitting cells according to the level of a driving voltage.

4. The light emitting module according to claim 1, wherein the $n^{th}$ light emitting cells of the first to $M^{th}$ light emitting devices are connected to each other in parallel.

5. The light emitting module according to claim 1, wherein the first to $M^{th}$ light emitting devices are provided on the body to be spaced apart by an equal distance from each other.

6. The light emitting module according to claim 1, wherein the first to $M^{th}$ light emitting devices are provided on the body to be spaced apart by different distances from each other.

7. The light emitting module according to claim 5, wherein a separation distance between the first to $M^{th}$ light emitting devices is 72°.

8. The light emitting module according to claim 5, wherein a separation distance between the first to $M^{th}$ light emitting devices is 90°.

9. The light emitting module according to claim 5, wherein a separation distance between the first to $M^{th}$ light emitting devices is 120°.

10. The light emitting module according to claim 5, wherein the first to $M^{th}$ light emitting devices are radially provided on the body.

11. The light emitting module according to claim 10, wherein the first to $M^{th}$ light emitting devices are provided with the turn-on controller as a center.

12. The light emitting module according to claim 2, wherein the turn-on controller comprises:

first to $M^{th}$ switches provided between adjacent ones of the first to $N^{th}$ light emitting cells and forming a path through which current flows in the adjacent light emitting cells; and a switching controller controlling switching of the first to $M^{th}$ switches according to the level of the driving voltage.

13. The light emitting module according to claim 1, wherein M=N=4.

14. The light emitting module according to claim 1, wherein the first to $N^{th}$ light emitting cells of each of the first to $M^{th}$ light emitting devices are provided an equal distance from each other.

15. The light emitting module according to claim 1, wherein the turn-on controller is provided at a center of the body.

16. The light emitting module according to claim 1, wherein the turn-on controller is provided at an edge portion of the body.

17. The light emitting module according to claim 1, wherein light emitting regions of the light emitting structures of the $n^{th}$ light emitting cells of the first to $M^{th}$ light emitting devices have the same area.

18. A light emitting module, comprising:

a body;

first to $M^{th}$ (wherein, M is an integer of 2 or greater) light emitting devices provided on the body to be spaced apart from each other;

a rectifier rectifying an alternating current signal applied from the outside to convert the alternating current signal into a ripple signal; and a turn-on controller controlling the first to $M^{th}$ light emitting devices to turn on according to the level of the ripple signal, wherein an $m^{th}$ ($1 \leq m \leq M$) light emitting device among the first to $M^{th}$ light emitting devices comprises first to $N^{th}$ (wherein, N is an integer of 2 or greater) light emitting cells connected to each other in series, wherein the turn-on controller simultaneously turns on or turns off $n^{th}$ light emitting cells of the first to $M^{th}$ light emitting devices, and wherein the first to $M^{th}$ light emitting devices are provided on the body to be spaced apart by different distances from each other.

19. A lighting unit having the lighting module of claim 1, wherein the lighting unit comprises:

a case body;

a connection terminal installed at the case body and receiving power; and the light emitting module installed at the case body.

20. The light emitting module according to claim 1, wherein the $n^{th}$ light emitting cells of the first to $M^{th}$ light emitting devices are connected to each other in parallel.

* * * * *